United States Patent [19]

Ramler

[11] 3,984,726

[45] Oct. 5, 1976

[54] ULTRAVIOLET LIGHT SYSTEM HAVING MEANS FOR MAINTAINING CONSTANT INTENSITY LIGHT PROFILE

[75] Inventor: Warren J. Ramler, Elmhurst, Ill.

[73] Assignee: PPG Industries, Inc., Pittsburgh, Pa.

[22] Filed: Apr. 25, 1975

[21] Appl. No.: 571,676

[52] U.S. Cl. ..... 315/107; 34/4; 240/44.2; 315/154; 315/297

[51] Int. Cl.[2] ..... H05B 41/39; H05B 37/02

[58] Field of Search ..... 315/322, 312, 91, 154, 315/152, 149, 155, 301, 296, 117, 151, 121, 123, 127, 295

[56] References Cited

UNITED STATES PATENTS

| | | | |
|---|---|---|---|
| 2,030,854 | 2/1936 | Calver | 315/154 X |
| 2,691,746 | 10/1954 | Zwikker | 315/121 X |
| 2,933,650 | 4/1960 | Tyrwhitt et al. | 315/322 X |
| 3,309,565 | 3/1967 | Clark et al. | 315/117 |
| 3,644,785 | 2/1972 | Jarmar | 315/297 X |
| 3,733,709 | 5/1973 | Bassemir et al. | 34/4 |
| 3,745,307 | 7/1973 | Peek et al. | 219/388 |
| 3,796,915 | 3/1974 | Bickl et al. | 315/312 |
| 3,826,014 | 7/1974 | Helding | 34/1 |

*Primary Examiner*—Robert Segal
*Attorney, Agent, or Firm*—George D. Morris

[57] ABSTRACT

Ultraviolet light processors containing a plurality of ultraviolet light sources are improved by providing means for increasing the intensity of one lamp to compensate for a reduction in intensity of another lamp so that the total intensity of the system is substantially the same. If both lamps are located at the first foci of a conjugate reflector system, the intensity profile will be substantially reestablished.

19 Claims, 15 Drawing Figures

ULTRAVIOLET LIGHT SYSTEM HAVING MEANS FOR MAINTAINING CONSTANT INTENSITY LIGHT PROFILE

Processes in which products are treated with ultraviolet light, such as to effect polymerization, sterilization, etc., are becoming of increasing interest. The use of ultraviolet light coating processors to cure ultraviolet light sensitive coatings is especially becoming more widespread. Advantages of ultraviolet light curing include the ability to use resin systems which have little or no volatile solvents, the speed with which cure may be accomplished and simplicity of operation.

Ultraviolet light processors often employ a plurality of concave substantially elliptical cylindrical reflectors having first foci and second foci located more remotely from the reflectors than the first foci. Light from generally linear parallel sources of ultraviolet light located at the first foci of the reflectors is reflected by the reflectors to the second foci. The second foci are arranged to produce a desired intensity profile at the surface of least curvature which contains the second foci. The second foci are superimposed or located apart, depending upon the intensity profile desired.

In operation, a substrate having an ultraviolet light curable coating thereon is passed through the ultraviolet light at or near the second foci to cure the coating into a hard film, or in certain cases, into a gelled film. For purposes of economy, the intensity of the light and time of exposure are usually maintained near the minimum values required to achieve a satisfactory cure. These minimum values vary, depending on the specific nature of the coating composition employed.

One problem that has caused difficulty in the use of ultraviolet light processors is the reduction in intensity of one or more of the sources of ultraviolet light, usually caused by a burnout of an ultraviolet light emitting lamp. This upsets the intensity profile by causing all or one or more portions of the profile to drop below an intensity which produces a satisfactory cure during the time allowed for exposure. The result is that all or portions of the coating are not cured satisfactorily.

The present invention serves to alleviate the above problem by permitting the total intensity of the sources of ultraviolet light to be substantially reestablished to that before the reduction. The preferred embodiment also permits the intensity profile at the surface of least curvature which contains the second foci to be reestablished to substantially the same intensity profile before the reduction of intensity.

For a better understanding of the invention, reference may be made to the drawings wherein like reference numerals refer to like parts in which.

The ultraviolet light processors of the invention have a plurality of substantially elliptical cylindrical reflectors for reflecting light from generally linear parallel sources of ultraviolet light located at the first foci of the reflectors to the second foci thereof, the second foci being more remotely located from the reflectors than the first foci. In the preferred embodiment, the second focus of at least one of the reflectors is common with the second focus of at least another of the reflectors to form at least one conjugate reflector system. Also present is means for increasing the intensity of at least one of the sources of ultraviolet light in the optical system from a lower operating intensity to a higher operating intensity.

Figure 1:
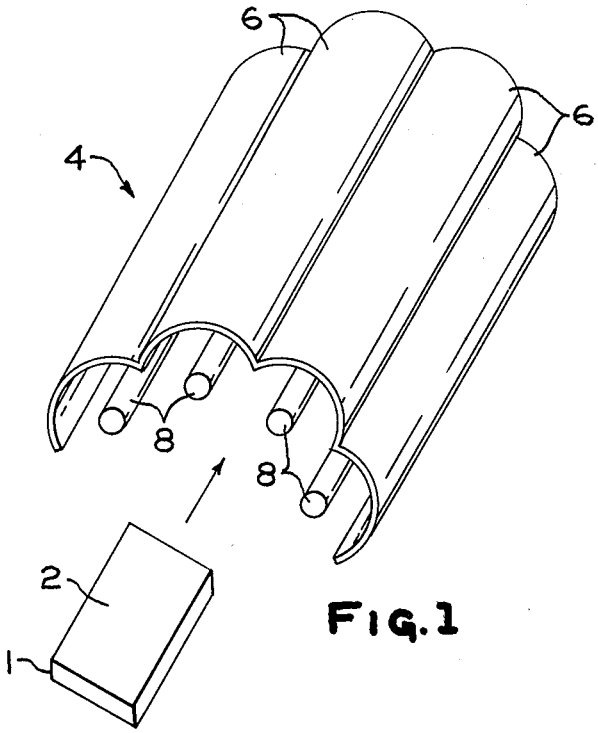
FIG. 1 illustrates the passage of a flat coated substrate under a plurality of sources of ultraviolet light in a direction parallel to the linear foci of the reflectors.
Figure 2:
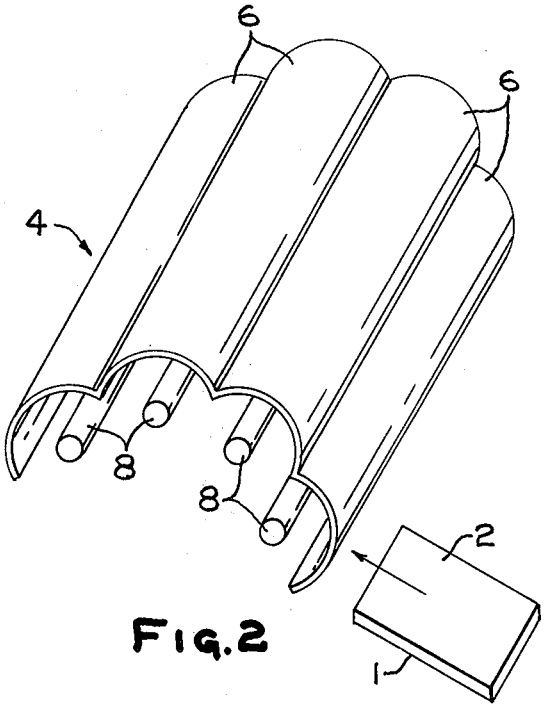
FIG. 2 illustrates the passage of a flat coated substrate under a plurality of sources of ultraviolet light in a direction transverse to the linear foci of the reflectors.

Referring now in more detail to the FIGURES where the invention will be described with respect to illustrative embodiments thereof, FIGS. 1, 2, 3 and 4 show a substrate 1 having thereon a coating 2 of an ultraviolet light curable composition passing under a cluster 4 of four concave substantially elliptical reflectors 6 having mercury vapor ultraviolet light emitting lamps 8 at the first foci of the reflectors. The coating 2 passes under the cluster at or near the second foci of the reflectors. In FIGS. 1 and 2, the coated substrate is flat whereas in FIGS. 3 and 4, the coated substrate is a right circular cylinder mounted on a rotating mandrel 10. The coated substrates may be passed beneath the cluster by conventional means, not shown, which is frequently a conveyor belt in the case of flat substrates or a link chain bearing the rotating mandrel in the case of right circular cylindrical substrates.

Figure 5:
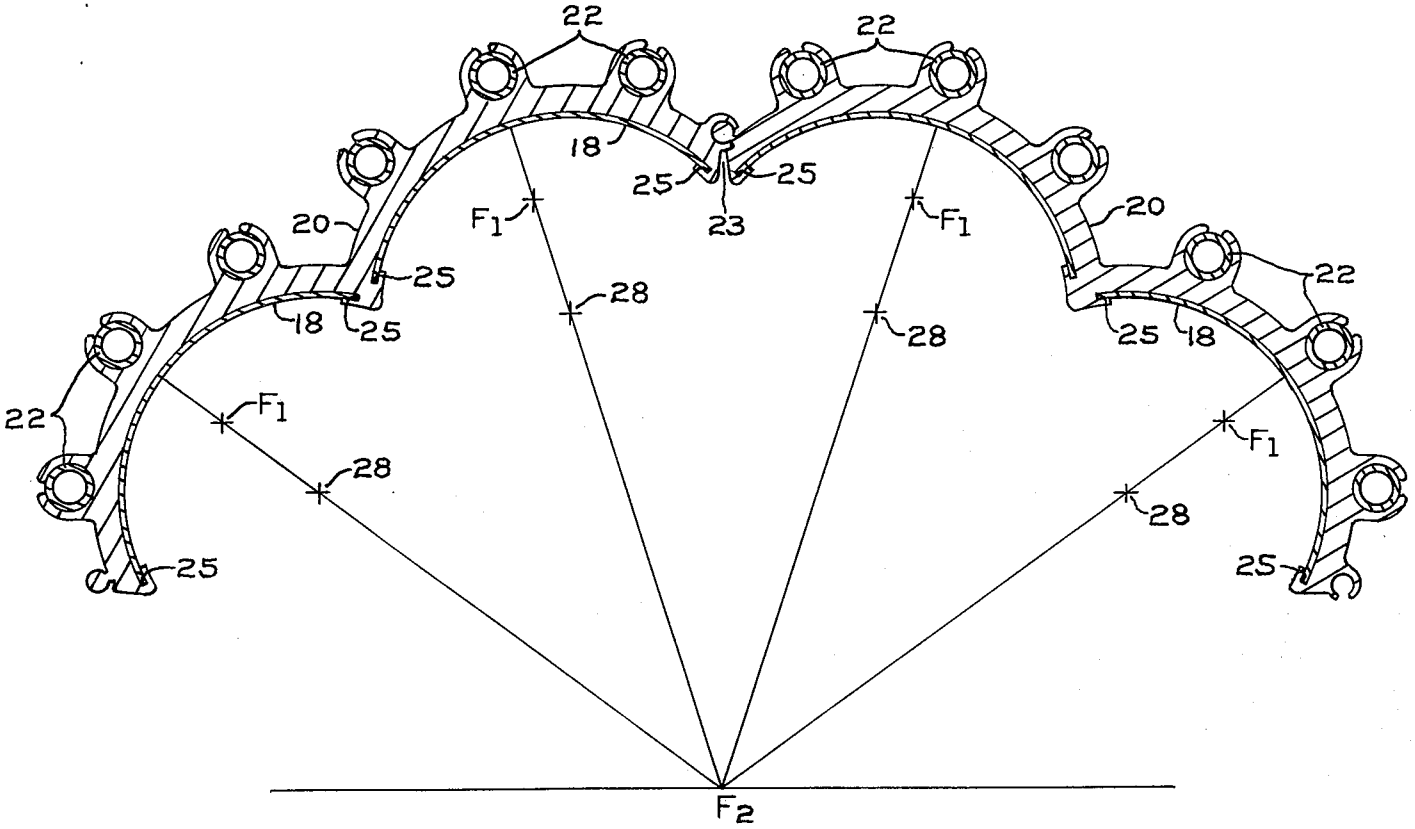
FIGS. 5, 6, 7, 8 and 9 illustrate some of the various reflector configurations which may be used in embodiments of the invention.

FIG. 5 illustrates a conjugate reflector system which may be utilized in the practice of the invention. The substantially elliptical cylindrical reflectors 18 are held in position by base members 20 which may also contain tubes 22 for recirculating coolant therethrough. The base members 20 may also contain a knuckle system 23 permitting relative rotational movement between the base members. The reflectors may be bright aluminum sheet (e.g., "Alzak", Aluminum Company of America; "Lurium", of European origin) or other ultraviolet light reflective material and may be held in place by slots 25 in base members 20. Each reflector has a first focus F, and a second focus more remotely located from the reflectors than the first foci. The four second foci are superimposed to form a common focus $F_2$.

Figure 3:
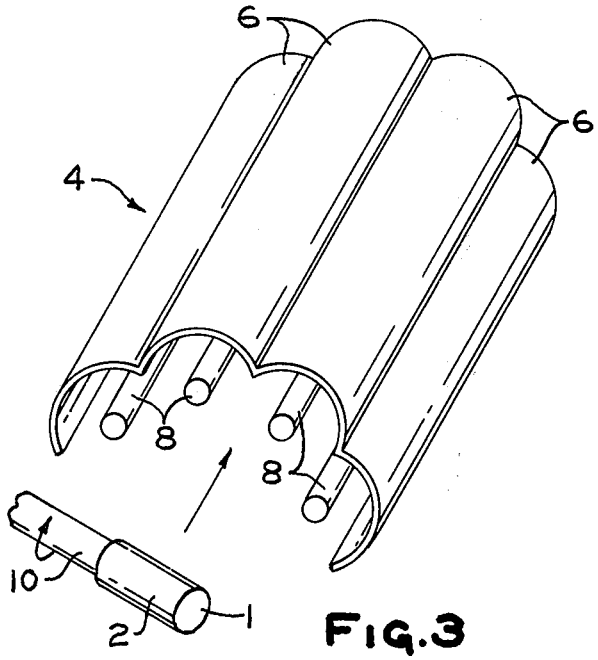
FIG. 3 illustrates the passage of a rotating right circular cylindrical coated substrate under a plurality of sources of ultraviolet light in a direction parallel to the linear foci of the reflectors.
Figure 4:
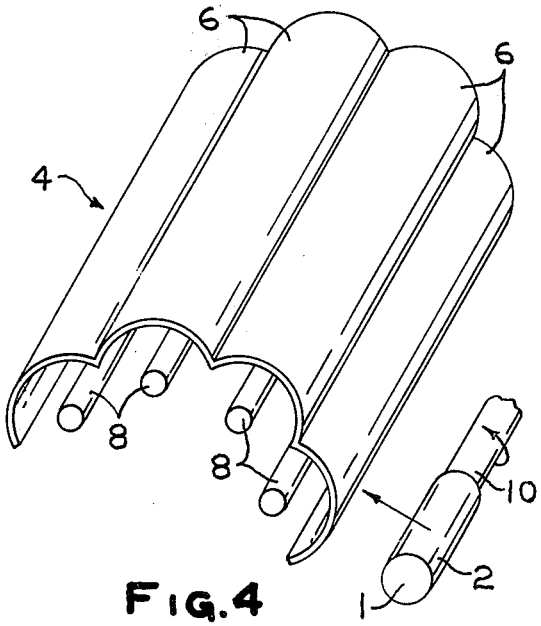
FIG. 4 illustrates the passage of a rotating right circular cylindrical coated substrate under a plurality of sources of ultraviolet light in a direction transverse to the linear foci.

The eccentricity of the substantially elliptical cylindrical reflectors is in the range of from about 0.2 to about 0.9 and is calculated from the formula $$e = Z-z/Z+z$$

where $e$ is the eccentricity, Z is the distance of the second focus from the vertex of the ellipse and $z$ is the distance of the first focus from the vertex of the ellipse. While precisely elliptical reflectors are often employed in the invention, shapes which substantially approximate an ellipse may be used so long as the aberrations introduced produce inconsequential effects upon the curing of ultraviolet light curable coatings. In most systems, a circle closely approximates an ellipse and may be used in lieu of a precise ellipse without introducing appreciable aberrations. Since most of the base members 20 are formed by extruding aluminum through a die, use of a circular arc permits easier fabrication of the die than if a precisely elliptical arc were employed. FIG. 3 illustrates the use of such circular arcs having centers 28 located on the major axes of the substantially elliptical cylindrical reflectors 18.

In the preferred embodiment of this conjugate reflector system, the base members 20 have circular arcs 3.969 centimeters in radius with centers 28 on the major axes of the substantially elliptical cylindrical reflectors 18. The reflectors themselves are sheets of Alzak aluminum having a thickness of about 0.074 centimeters. The first foci are located 2.223 centimeters from the vertices of their respective substantially elliptical cylindrical reflectors. The common foci are located 13.738 centimeters from the vertices of their respective substantially elliptical cylindrical reflectors.

Figure 6:
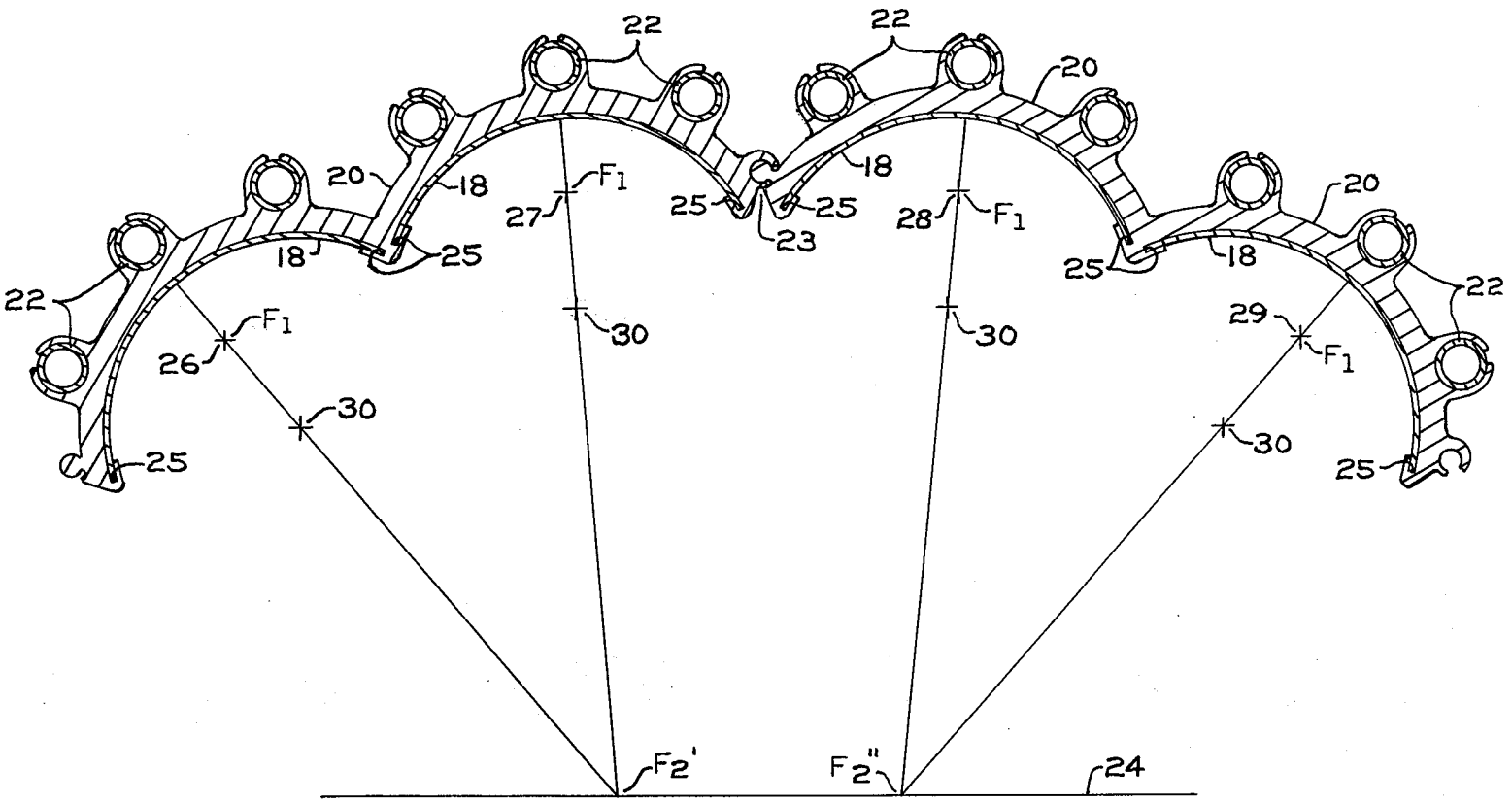

FIG. 6 illustrates an optical system comprising two conjugate reflector systems which may be utilized in the practice of the invention. The mechanical parts are the same as those described with respect to FIG. 5 but the two base members 20 have been rotated about the axis of knuckle system 23 to spread apart the first common focus $F_2'$ of the two left reflectors and the second common focus $F_2''$ of the two right reflectors. The two common foci lie in plane 24, which is the surface of least curvature containing the two common foci, and are spaced apart by a distance usually in the range of from about 10 percent to about 50 percent of the distance between the two extreme firt foci 26 and 29.

Figure 7:
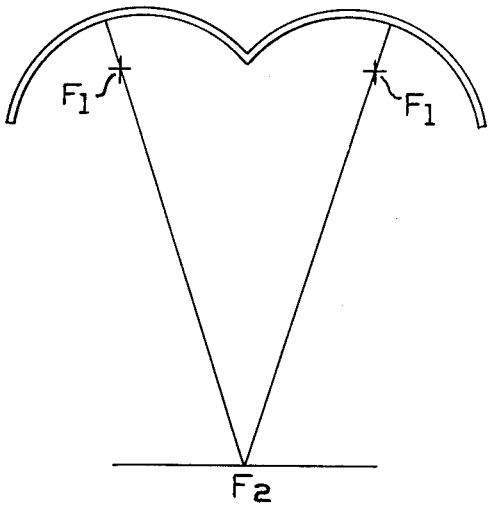
Figure 8:
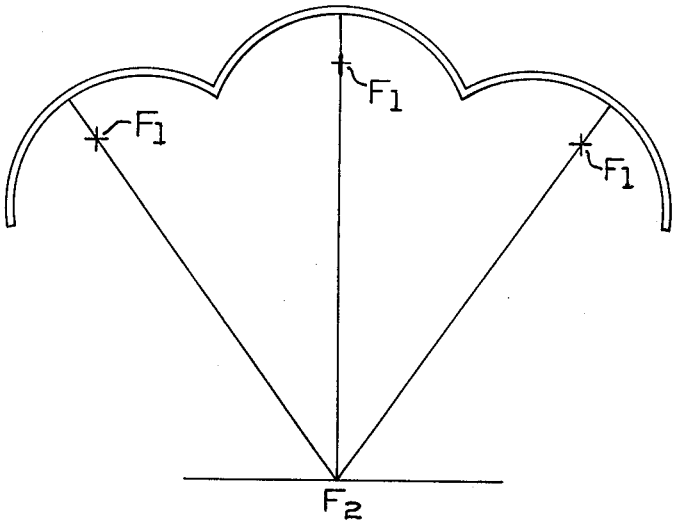
Figure 9:
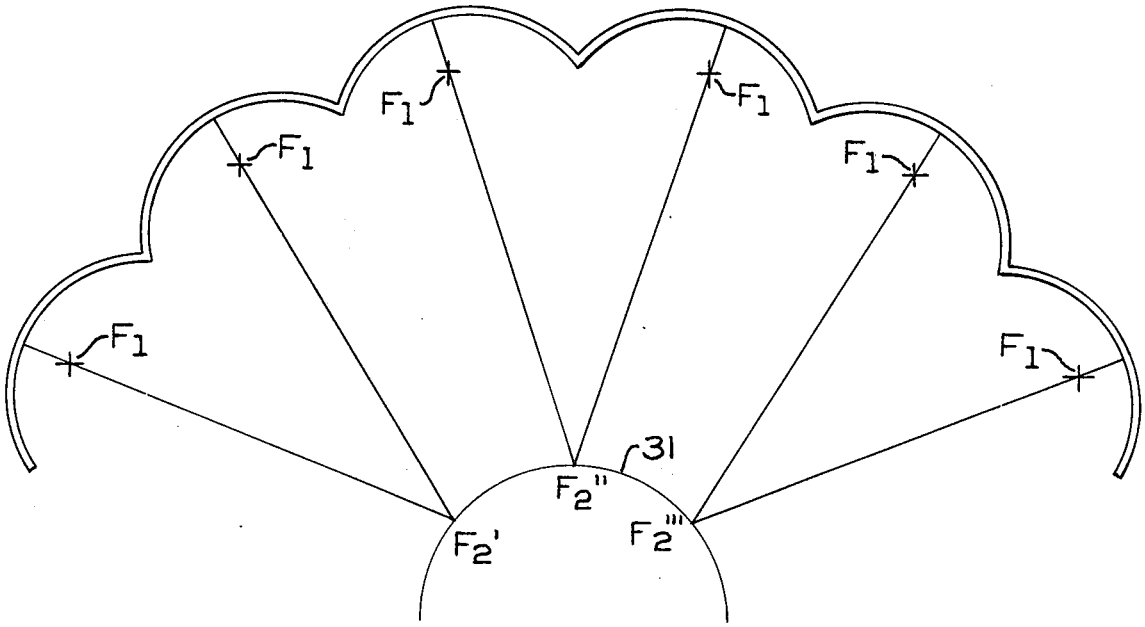

In the preferred embodiment of this optical system, the base members 20 have circular arc 3.969 centimeters in radius with centers 30 on the major axes of the substantially elliptical cylindrical reflectors 18. The reflectors themselves are sheets of Alzak aluminum having a thicknessof about 0.074 centimeters. The first foci are located 2.223 centimeters from the vertices of their respective substantially elliptical cylindrical reflectors. The first and second common foci are located 13.738 centimeters from the vertices of their respective substantially elliptical cylindrical reflectors. The common foci are spaced 6.350 centimeters apart and are positioned equidistant from the plane of symmetry of the reflector system which is generally parallel to the four generally parallel first foci. FIGS. 7, 8 and 9 illustrate still other optical systems which may be utilized in the practice of the invention. FIG. 7 shows a conjugate reflector system comprising two reflectors having a common focus $F_2$. FIG. 8 shows a conjugate reflector system comprising three reflectors having a common focus $F_2$. FIG. 9 shows an optical system comprising three conjugate reflector systems of two reflectors each. The common foci $F_2'$, $F_2''$ and $F_2'''$, respectively of each conjugate reflector system are spaced apart and lie in cylindrical surface 31, which is the surface of least curvature containing the three common foci.

Figure 10:
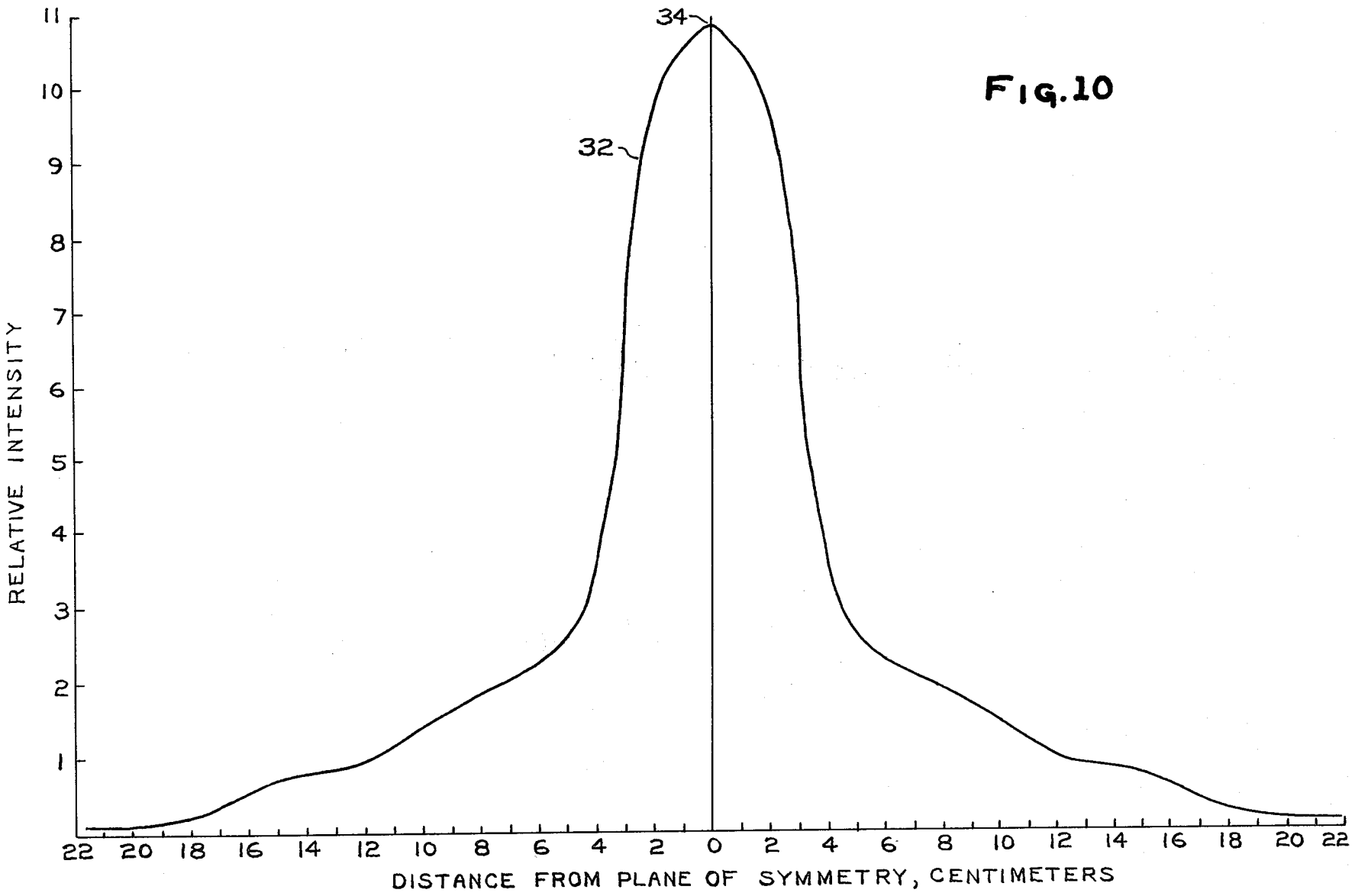
FIG. 10 shows the intensity profile of the reflector system of FIG. 5 with ultraviolet light sources of the same intensity.

FIG. 10 illustrates the intensity profile when generally parallel ultraviolet light sources of equal intensity are located at the first foci of the preferred embodiment of the conjugate reflector system of FIG. 5. The intensity profile 32 at the horizontal plane containing the common foci forms a peaked wave having a single maximum 34.

Figure 11:
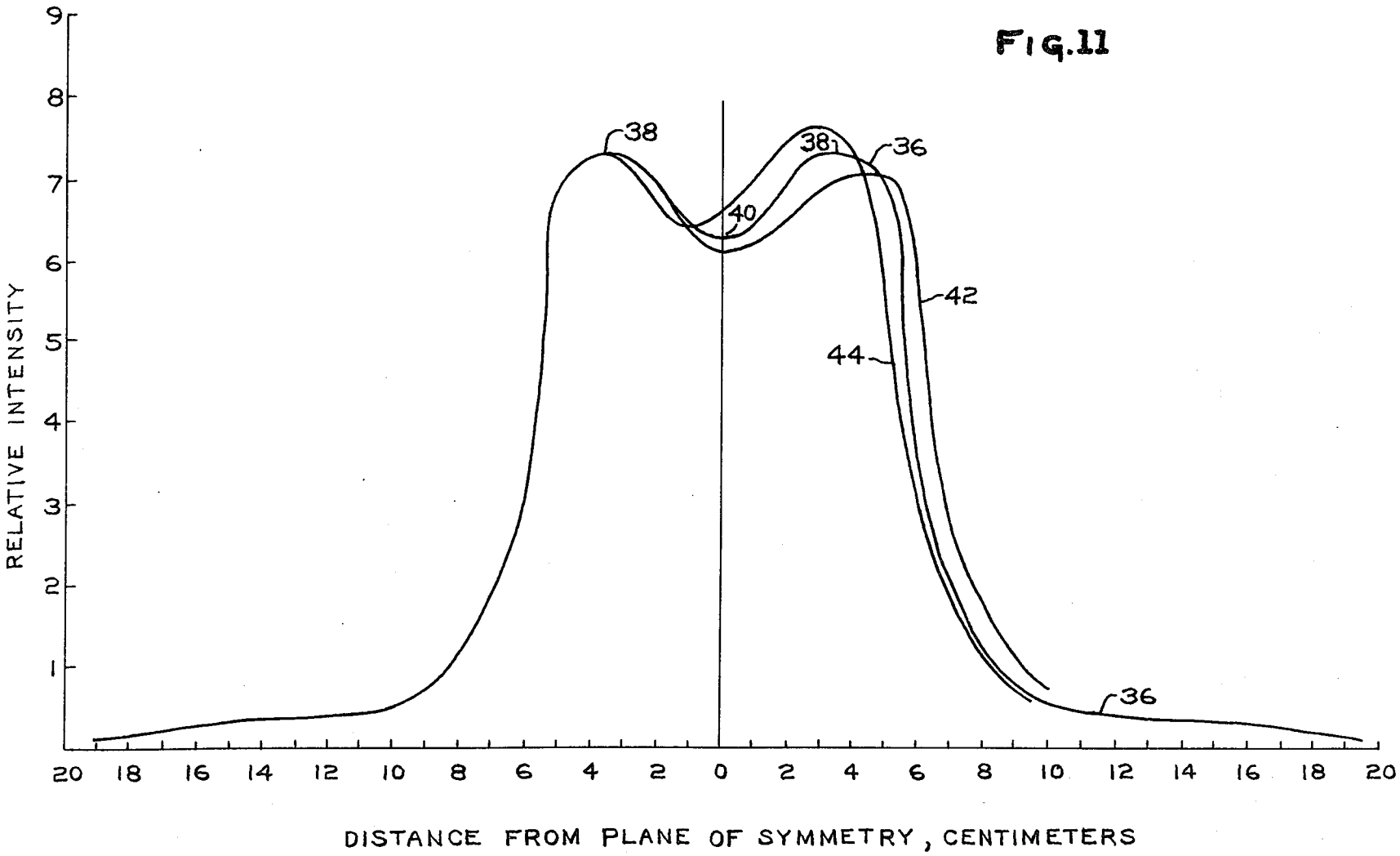
FIG. 11 shows intensity profiles of the reflector system of FIG. 6 with ultraviolet light sources of varying intensity.

FIG. 11 illustrates the intensity profiles at plane 24 when generally parallel ultraviolet light sources of various intensities are located at the first foci of the preferred embodiment of the optical system of FIG. 6. The intensity profile 36 represents the case when ultraviolet light sources of equal intensity are located at each of the four first foci 26, 27, 28 and 29. The intensity profile 36 approximates a square wave and has two maxima 38 separated by a central minimum 40. The intensity profile 42 represents the situation when the two lamps located at first foci 26 and 27, respectively, are emitting with the same intensity as for intensity profile 36, the lamp located at first focus 28 is not emitting and the lamp located at first focus 29 is emitting with twice the intensity of either of the lamps located at first foci 26 or 27. It will be observed that the intensity profile has been reestablished to substantially that of intensity profile 36, although one lamp is extinguished. The intensity profile 44 illustrates the case when the two lamps located at first foci 26 and 27, respectively, are emitting with the same intensity as for intensity profile 36, the lamp located at first focus 28 is emitting with twice the intensity of either of the lamps located at first foci 26 or 27 and the lamp located at first focus 29 is not emitting. It will be observed that again the intensity profile has been reestablished to substantially that of intensity profile 36, although one lamp is extinguished.

Figure 12:
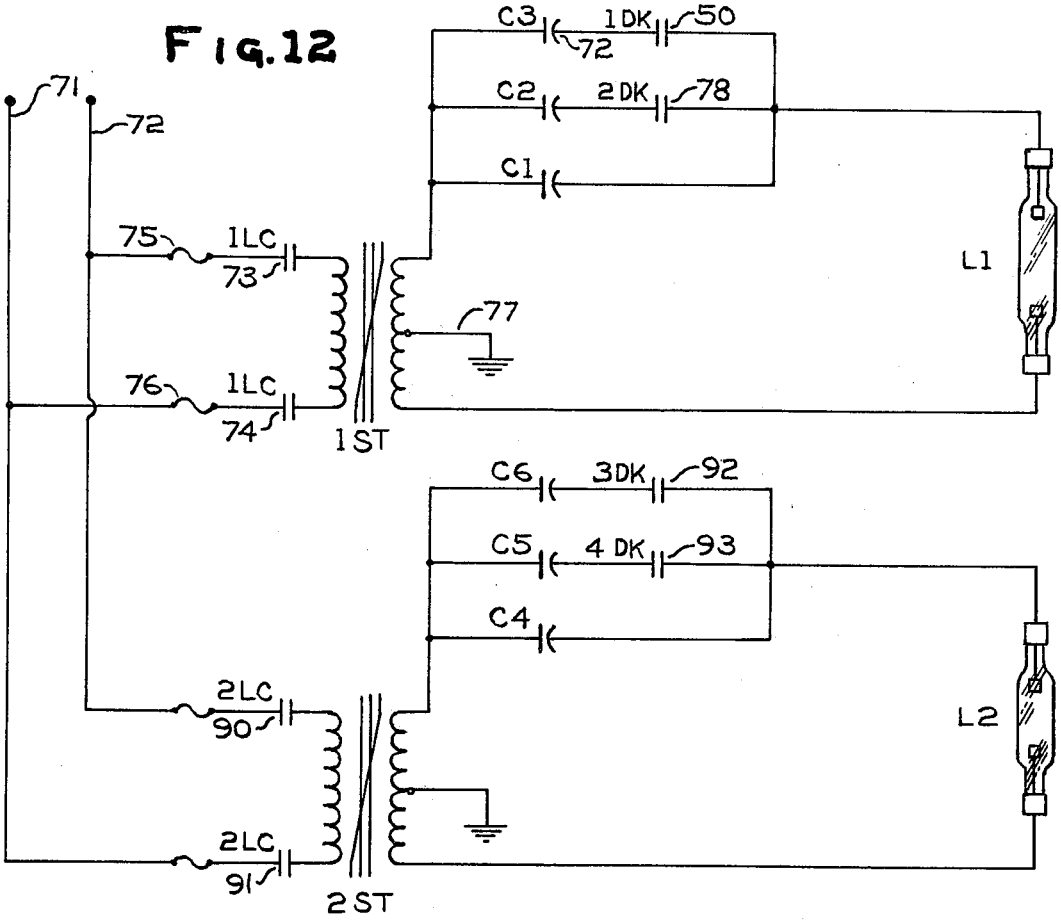
FIG. 12 shows an electrical system for supplying electrical power to ultraviolet light emitting lamps.
Figure 14:
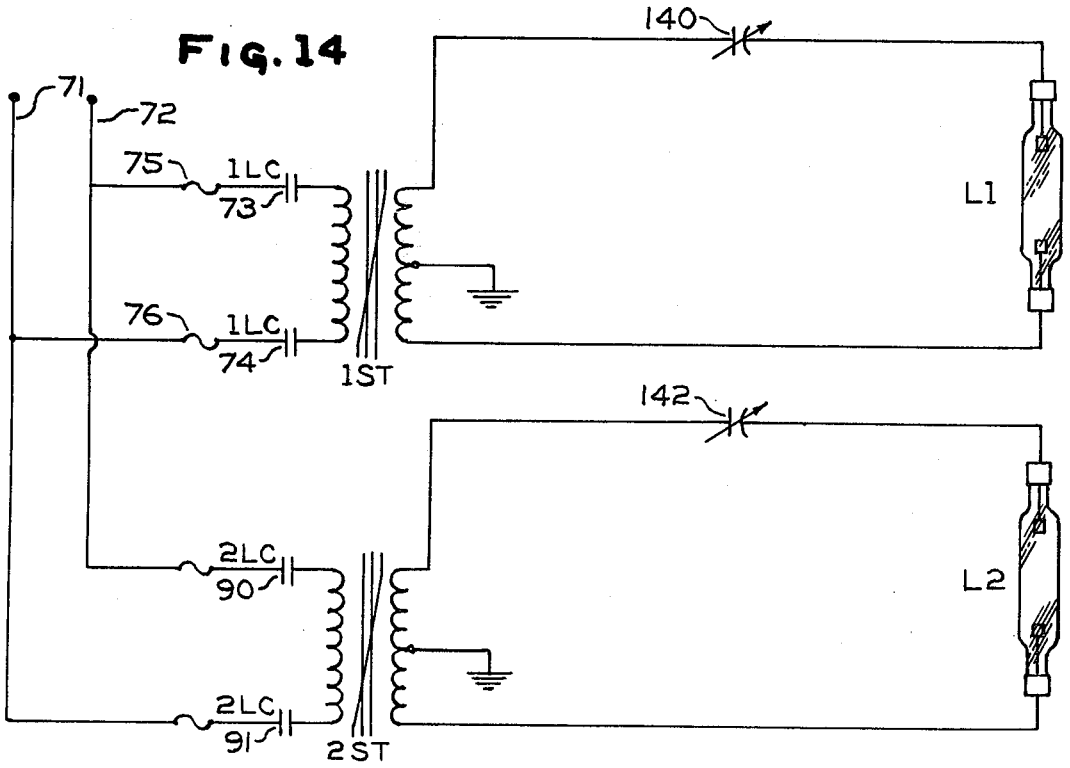
FIG. 14 shows an electrical system which is a modification of the electrical system of FIG. 12.
Figure 13:
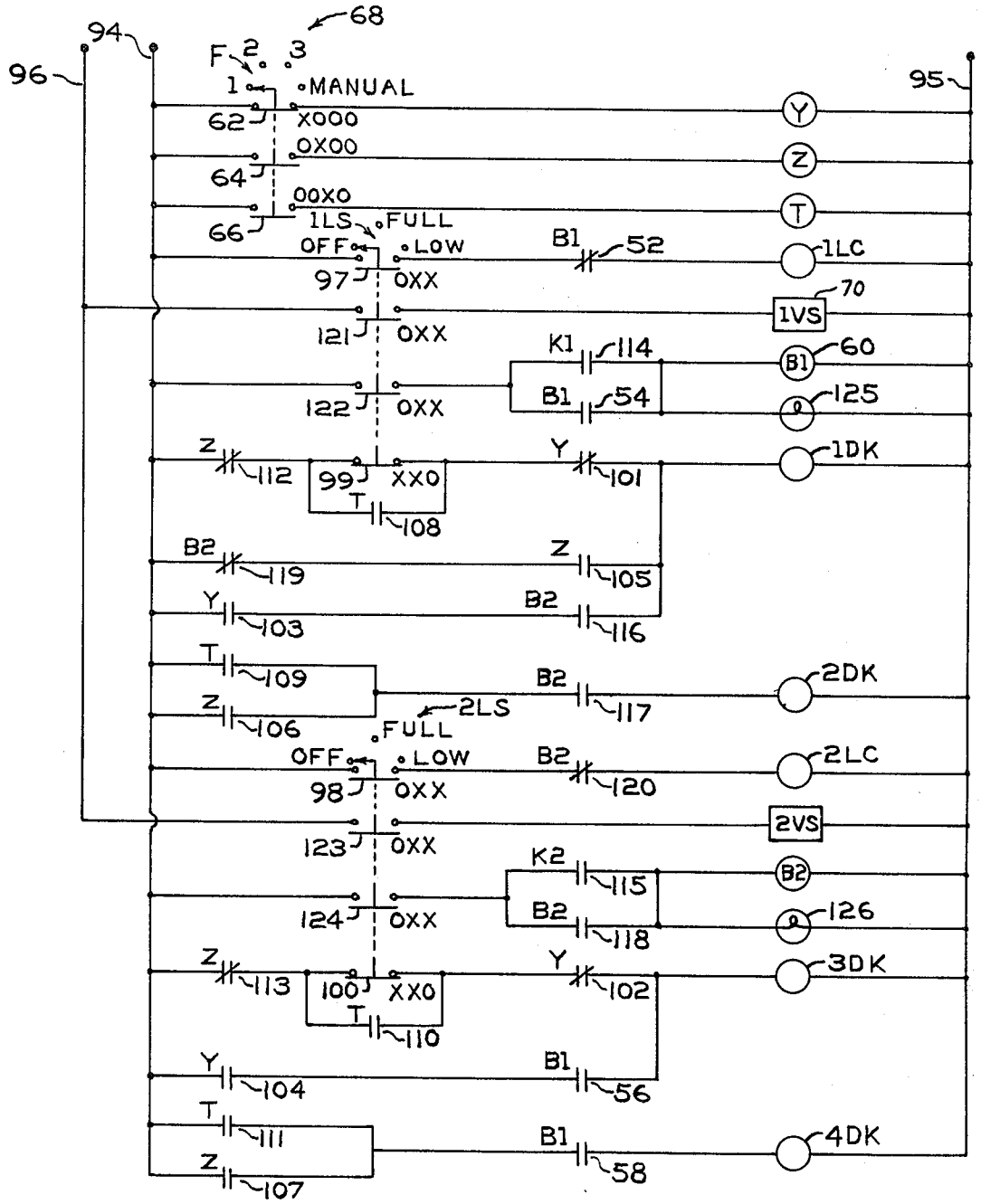
FIG. 13 shows a control system for operating the electrical system of FIG. 12.

In FIGS. 12, 13 and 14, the descriptions of which follow, normally open contacts of switches are represented by two spaced, vertical, parallel lines such as for contacts 50 in FIG. 12. Normally closed contacts of switches are represented by two spaced, vertical, parallel lines transversed by a diagonal such as for contacts 52 in FIG. 13. Switches with the same nomenclature are moved simultaneously. For example, when switch B1 of FIG. 13 is activated, contacts 52 are opened, contacts 54 are closed, contacts 56 are closed and contacts 58 are closed, all substantially simultaneously. Solenoids are represented by circles identified by nomenclature corresponding to the switches activated. Activation of solenoid B1, which is the same as solenoid 60, simultaneously activates switch B1 and, consequently, all contacts identified as B1. Gang switches are represented in the manner of switch F, comprising contacts 62, 64 and 66, respectively, which are shown in the drawing for the most counterclockwise position of the switch. Adjacent each set of contacts is a diagram showing positions of the contacts for each position of the control knob as the control knob is turned clockwise. Closed contacts are represented by X, and open contacts are represented by 0. The symbol for contacts 62 is X000 which means that when control knob 68 is in the 1 position, contacts 62 are closed; when control knob 68 is in the 2 position, contacts 62 are open; when control knob 68 is in the 3 position, contacts 62 are open; when control knob 68 is in the manual position, contacts 62 are open. Voltage sensors are represented by rectangles containing identifying nomenclature, as for example, voltage sensor IVS, which is the same as voltage sensor 70. Capacitors are represented by a spaced line and arc, as for example, capacitor C3, which is the same as capacitor 72.

FIG. 12 represents an electrical system which may be used to supply power to two ultraviolet light emitting lamps which may advantageously be two lamps of a conjugate reflector system. Electrical power is supplied from a source, not shown, through lines 71 and 72. Activation of switch 1LC closes contacts 73 and 74 thereby supplying power to the primary of saturable core transformer 1ST through protective fuses 75 and 76. The center tap 77 of saturable transformer 1ST is grounded. Power is supplied from the secondary of saturable core transformer 1ST through capacitor C1 to ultraviolet light emitting mercury vapor lamp L1. Connected in parallel to capacitor C1 are capacitor C2 and contacts 78 of switch 2DK. Also connected in parallel to capacitor C1 are capacitor C3 and contacts 50 of switch 1DK. The value of capacitor C1 is chosen such that when contacts 78 and contacts 50 are both open, lamp L1 emits about one quarter of its maximum desired operating intensity. The value of capacitor C2 is chosen such that when contacts 78 are closed and contacts 50 are open, lamp L1 emits about three quarters of its maximum desired operating intensity. The value of capacitor C3 is chosen such that when contacts 50 are closed and contacts 78 are open, lamp L1 emits about one half of its maximum desired operating intensity. The values are additive; therefore, if contacts 50 and contacts 78 are both closed, lamp L1 emits at about its maximum desired operating intensity. If the maximum desired operating intensity of the lamp is represented by E, it will be observed that C1 alone corresponds to (¼)E, C2 alone corresponds to (½)E and C3 alone corresponds to (¼)E.

The maximum desired operating intensity of lamp L2 is preferably about the same as that of lamp L1. The values of capacitors C4, C5 and C6 are chosen in a manner analogous to that described with respect to the values of capacitors C1, C2 and C3, respectively. Switch 2LC, comprising contacts 90 and 91 is analogous in structure and function to switch 1LC, comprising contacts 73 and 74. Saturable core transformer 2ST is analogous in structure and function to saturable core transformer 1ST.

Switches 1LC, 1DK, 2LC, 3DK and 4DK may be operated manually if desired. By proper manipulation of these switches, the total intensity of the two lamps can be varied from zero to 2E in quarter intensity increments. For example, if contacts 73 and 74 are closed and contacts 90 and 91 are open, the total intensity is (¼)E. If contacts 73, 74, 78, 90, 91, 92 and 93 are closed and contacts 50 are open, the total intensity is (1-¾)E. If contacts 73, 74, 50, 78, 90, 91, 92 and 93 are all closed, the total intensity is 2E. The flexibility of the above system permits wide variation in the establishment of a desired operating intensity of the optical system.

Should the operating intensity of one lamp diminish, the intensity of the other lamp may be increased to substantially reestablish the initial total intensity of the two lamps, provided that the required higher operating intensity of the other lamp can be attained without failure of the lamp. As an example, where initial operating conditions are such that contacts 73, 74, 78, 90, 91 and 93 are open and contacts 50 and 92 are closed, lamps L1 and L2 are each operating at an intensity (¾)E and the total intensity is (1-½)E. If after a period of time the operating characteristics of lamp L1 change so that it emits with an intensity of (½)E, closure of contacts 92 increases the intensity of lamp L2 to E and reestablishes the total intensity to (1-½)E. If lamps L1 and L2 are oriented at the first foci of a conjugate reflector system, the intensity profile of the system will also be substantially reestablished.

Most often, significant reductions in the intensity of a lamp occur through complete failure of the lamp. The principles described above may be applied to substantially reestablish the total intensity of such lamps as are functional to the initial operating level and, if the lamps are located at the first foci of a conjugate reflector system, to substantially reestablish the initial intensity profile. As an example, where initial operating conditions are such that contacts 73, 74, 50, 90, 91 and 92 are closed and contacts 78 and 93 are open, lamps L1 and L2 are each operating at an intensity (½)E and the total intensity is E. If after failure of lamp L2 contacts 50 are closed, the intensity of lamp L1 is increased to E and the total intensity of the system is reestablished at E.

Although FIG. 12 illustrates a power supply system for two lamps, it will be observed that the modular system for one lamp is a substantial duplicate of the modular system for the other lamp. It will be appreciated, then, that a power supply system for any greater number of lamps can be constructed by the simple expedient of adding additional modular systems to the power supply system of FIG. 12.

While operation of the various contacts of FIG. 12 may be accomplished manually, it is preferred that the contacts be incorporated into a system comprising means for detecting the failure of a lamp and means for automatically increasing the intensity of at least one other lamp in response to a detection of such failure so that the total intensity of the ultraviolet light emission is substantially reestablished to the initial operating value. It is preferred that the lamps be located at the first foci of a conjugate reflector system so that the intensity profile will also be substantially reestablished. It is also preferred that the system include means for varying the total intensity of the sources of ultraviolet light located at the first foci of the reflectors of the optical system. Such a system for two lamps is illustrated in FIGS. 12 and 13 where FIG. 12 shows the power supply system and FIG. 13 shows a lamp failure detection system, an automatic switching system and a manual switching system.

Electrical power for the various solenoids and indicator lamps is supplied from a source, not shown, through lines 94 and 95. Advantageously, such power may be supplied at a potential of about 117 volts AC. Electrical power for the various voltage sensors is supplied from a source, not shown, through lines 96 and 95. Advantageously, such power may be supplied at a potential of about 24 volts AC.

When switch 1LS is in the off position, contacts 97 are open and solenoid 1LC is not activated. Since contacts 73 and 74 of switch 1LC are open when solenoid 1LC is not activated, no power is supplied to the primary of saturable core transformer 1ST and lamp L1 is off. Similarly, when switch 2LS is in the off position, contacts 98 are open and solenoid 2LC is not activated. Since contacts 90 and 91 of switch 2LC are open when solenoid 1LC is not activated, no power is supplied to the primary of saturable core transformer 2ST and lamp 2 is off. The position of switch F is therefore immaterial when switches 1LS and 2LS are both in the off position.

When switch F is in the manual position, contacts 62, 64 and 66 are all open and none of solenoids Y, Z and T is activated. Therefore, contacts 103, 104, 105, 106, 107, 108, 109, 110 and 111 remain open and contacts 101, 102, 112 and 113 remain closed. When switch 1LS is in the low position, contacts 97 are closed, activating solenoid 1LC which closes contacts 73 and 74. Power is accordingly supplied through capacitor C1 to lamp L1. Since contacts 99 of switch 1LS are open, solenoid 1DK is not activated, and contacts 50 of switch 1DK remain open. Moreover, solenoid 2DK is not activated and contacts 78 of switch 2DK remain open. Power is therefore supplied to lamp L1 only through capacitor C1, and lamp L1 operates at (¼)E. When switch 1LS is in the high position, contacts 97 are closed, ultimately causing power to be supplied lamp L1 through capacitor C1 as hereinbefore described. However, when switch 1LS is in the high position, contacts 99 are closed, and solenoid 1DK is activated which closes contacts 50 of switch 1DK. Power is therefore also supplied to lamp L1 through capacitor C3. When power is supplied to lamp L1 through both capacitors C1 and C3, lamp L1 operates at (½)E. Since solenoid 2DK cannot be activated when switch F is in the manual position, contacts 78 of switch 2DK remain open, and power cannot be supplied to lamp L1 through capacitor C2.

When switch F is in the manual position and when switch 2LS is in the low position, contacts 98 are closed, activating solenoid 2LC which closes contacts 90 and 91. Power is accordingly supplied through capacitor C4 to lamp L2. Since contacts 100 of switch 2LS are open, solenoid 3DK is not activated, and contacts 92 of switch 2DK remain open. Power is therefore supplied to lamp L2 only through capacitor C4 and lamp L2 operates at (¼)E. When switch 2LS is in the high position, contacts 98 are closed, ultimately causing power to be supplied lamp L2 through capacitor C4 as hereinbefore described. However, when switch 2LS is in the high position, contacts 100 are closed and solenoid 3DK is activated which closes contacts 92 of switch 3DK. Power is therefore also supplied to lamp L2 through capacitor C6. When power is supplied to lamp L2 through both capacitors C4 and C6, lamp L2 operates at (½)E. Since solenoid 4DK cannot be activated when switch F is in the manual position, contacts 93 of switch 4DK remain open, and power cannot be supplied to lamp L2 through capacitor C5.

When switch F is in the manual position, either or both lamps L1 and L2 may be off, emitting at (¼)E or emitting at (½)E. Total intensity of the two lamp system may therefore be zero, (¼)E, (½)E, (¾)E or E. When switch is in the manual position, failure of either lamp will not affect operation of the other lamp.

When switch F is in the 1, 2 or 3 position, lamp L1 may be turned off by placing switch 1LS in the off position or lamp L1 may be turned on by placing switch 1LS in either the full position or the low position. Similarly, when switch F is in the 1, 2 or 3 position, lamp L2 may be turned off by placing switch 2LS in the off position or lamp L2 may be turned on by placing switch 2LS in either the full position or the low position.

When switch F is in the 1 position, the total intensity of the two lamp system is (½)E. With switch F in the 1 position, contacts 62 are closed and contacts 64 and 66 are open. Solenoid Y is therefore activated which opens contacts 101 and 102 and closes contacts 103 and 104. Solenoids Z and T remain inactivated, hence contacts 105, 106, 107, 108, 109, 110 and 111 remain open, and contacts 112 and 113 remain closed. Because contacts 114 of switch K1 remain open, solenoid B1 remains inactivated. Therefore, contacts 54, 56 and 58 remain open, and contacts 52 remain closed. Similarly, because contacts 115 of switch K2 remain open, solenoid B2 remains inactivated. Therefore, contacts 116, 177 and 118 remain open, and contacts 119 and 120 remain closed. When switch 1LS is in either the full position or the low position, contacts 121 and 122 are in the closed position. When switch 2LS is in either the full position or the low position, contacts 123 and 124 are in the closed position. Because contacts 121 are closed, power is supplied to voltage sensor 1VS which monitors the voltage drop across lamp L1. The voltage drop across the lamp is an inverse function of the intensity of the lamp. So long as the voltage drop across lamp L1 remains below that which represents a preestablished value of intensity which is below the normal operating intensity of lamp L1, voltage sensor 1VS does not actuate switch K1, and contacts 114 remain open. Because contacts 123 are closed, power is supplied to voltage sensor 2VS which monitors the voltage drop across lamp L2. So long as the voltage drop across lamp L2 remains below that which represents a preestablished value of intensity which is below the normal operating intensity of lamp L2, voltage sensor 2VS does not actuate switch K2 and contacts 115 remain open. Because fluctuations in intensity of a lamp sometimes vary by ± 20 percent of the mean intensity, it is preferred that the first and second preestablished values represent a decrease in intensity of the respective lamps of at least 20 percent of the normal operating intensity. It is especially preferred that the first and second preestablished values represent a decrease in intensity greater than 20 percent of the normal operating intensity.

When switch F is in the 1 position, both lamps are functioning and neither switch 1LS nor switch 2LS is in the off position, then solenoids 1DK, 2DK, 3DK and 4DK remain inactivated. Power is therefore supplied to lamp L1 through capacitor C1 and power is supplied to lamp L2 through capacitor C4. Lamp L1 and lamp L2 each emit with an intensity (¼)E, and the total intensity of the two lamp system is (½)E. If lamp L1 fails, the voltage drop across L1 rises to the total impressed secondary voltage of saturable core transformer 1ST, which is above the first preestablished value required for voltage sensor 1VS to activate switch K1. Activation of switch K1 closes contacts 114 which permits power to activate solenoid B1 and indicator light 125. Activation of solenoid B1 closes contacts 54, 56 and 58 and opens contacts 52. Opening of contacts 52 inactivates solenoid 1LC which causes contacts 73 and 74 of switch 1LC to open. This provides a safety feature by removing the application of electrical potential from lamp L1. Closure of contacts 54 provides a path for power to solenoid B1 and indicator light 125 which bypasses contacts 114 of switch K1. Therefore, when the voltage drop across lamp L1 is reduced to zero by the opening of contacts 52 of switch B1, voltage sensor 1VS detects a voltage difference below a second preestablished value (which is lower than the first preestablished value) and deactivates switch K1 which allows contacts 114 to open. Power continues to be supplied to solenoid B1 and indicator light 125 through contacts 122 and 54. Solenoid B1 and indicator light 125 remain activated until switch 1LS is turned to the off position, thereby opening contacts 122. Remembering that contacts 104 are closed because switch F is in the 1 position, the closure of contacts 56 permits power to activate solenoid 3DK which closes contacts 92. Closure of contacts 58 is ineffectual to actuate solenoid 4DK inasmuch as contacts 107 and 111 are both open. Power is supplied to lamp L2 through capacitors C4 and C6 so that lamp L2 now emits with an intensity (½)E. The net result of the failure of lamp L1 is seen to be that the intensity of lamp L2 is increased from (¼)E to (½)E so that the pre-burnout total intensity of (½)E is maintained. When lamp L1 and lamp L2 are located at the first foci of a conjugate reflector system, the intensity profile is also substantially reestablished.

If, on the other hand, lamp L2 rather than lamp L1 fails with switch F in the 1 position, the voltage drop across L1 rises to the total impressed secondary voltage of saturable core transformer 2ST, which is above the first preestablished value required for voltage sensor 2VS to activate switch K2. Activation of switch K2 closes contacts 115 which permits power to activate solenoid B2 and indicator light 126. Activation of solenoid B2 closes contacts 116, 117 and 118 and opens contacts 119 and 120. Opening of contacts 120 inactivates solenoid 2LC which causes contacts 90 and 91 of switch 2LC to open. This provides a safety feature by removing the application of electric potential from lamp L2. Closure of contacts 118 provides a path for power to solenoid B2 and indicator lamp 126 which bypasses contacts 115 of switch K2. Therefore, when the voltage drop across lamp L2 is reduced to zero by the opening of contacts 120 of switch B2, voltage sensor 2VS detects voltage difference below a second preset value (which is lower than the first preset value) and deactivates switch K2 which allows contacts 115 to open. Power continues to be supplied to solenoid B2 and indicator light 126 through contacts 124 and 118. Solenoid B2 and indicator light 126 remain activated until switch 2LS is turned to the off position, thereby opening contacts 124. Remembering that contacts 103 are closed because switch F is in the 1 position, the closure of contacts 116 permits power to activate solenoid 1DK which closes contacts 50 of switch 1DK. Closure of contacts 117 does not activate solenoid 2DK because contacts 106 and 109 are both open. Power is supplied to lamp L1 through capacitors C1 and C3 so that lamp L1 now emits with an intensity (½)E. The net result of the failure of lamp L2 is that the intensity of lamp L1 is increased from (¼)E to (½)E so that the pre-burnout total intensity of (½)E is maintained. When lamp L1 and lamp L2 are located at the first foci of a conjugate reflector system, the intensity profile is also substantially reestablished.

When switch F is in the 2 position, the total intensity of the two lamp system is (¾)E. With switch F in the 2 position, contacts 64 are closed and contacts 62 and 66 are open. Solenoid Z is therefore activated which opens contacts 112 and 113 and closes contacts 105, 106 and 107. Solenoids Y and T remain inactivated, hence contacts 103, 104, 108, 109, 110 and 111 remain open and contacts 101 and 102 remain closed. Because contacts 114 of switch K1 remain open, solenoid B1 remains inactivated. Therefore, contacts 54, 56 and 58 remain open and contacts 52 remain closed. Similarly, because contacts 115 of switch K2 remain open, solenoid B2 remains inactivated. Therefore, contacts 116, 117 and 118 remain open and contacts 119 and 120 remain closed. When switch 1LS is in either the full position or the low position, contacts 121 and 122 are in the closed position. When switch 2LS is in either the full position or the low position, contacts 123 and 124 are in the closed position. Because contacts 121 are closed, power is supplied to voltage sensor 1VS which functions as described previously. Because contacts 123 are closed, power is supplied to voltage sensor 2VS which functions as described previously.

When switch F is in the 2 position, both lamps are functioning and neither switch 1LS nor switch 2LS is in the off position, then solenoid 1DK is activated by power supplied through contacts 105 and 119 and solenoids 2DK, 3DK and 4DK remain inactivated. Activation of solenoid 1DK closes contacts 50 of switch 1DK. Power is therefore supplied to lamp L1 through capacitors C1 and C3 and power is supplied to lamp L2 through capacitor C4. Lamp L1 emits with an intensity (½)E and lamp L2 emits with an intensity (¼)E. The total intensity of the two lamp system is (¾)E. If lamp L1 fails, voltage sensor 1VS activates switch K1 which closes contacts 114 thereby permitting power to activate solenoid B1 and indicator light 125. Activation of solenoid B1 closes contacts 54, 56 and 58 and opens contacts 52. Opening of contacts 52 inactivates solenoid 1LC which causes contacts 73 and 74 of switch 1LC to open thereby removing the application of electrical potential from lamp L1. Closure of contacts 54 provides a path for power to solenoid B1 and indicator light 125 which bypasses contacts 114 of switch K1. The purpose and operation of this bypass are the same as heretofore described. Remembering that contacts 107 are closed because switch F is in the 2 position, the closure of contacts 58 permits power to activate solenoid 4DK which closes contacts 93 of switch 4DK. Closure of contacts 56 is ineffectual to activate solenoid 3DK because contacts 104 and 113 are both open. Power is supplied to lamp L2 through capacitors C4 and C5 so that lamp L2 now emits with an intensity (¾)E. The net result of the failure of lamp L1 is seen to be that the intensity of lamp L2 is increased from (¼)E to (¾)E so that the pre-burnout total intensity of (¾)E is maintained. When lamps L1 and L2 are located at the first foci of a conjugate reflector system, the intensity profile is also substantially reestablished.

If, on the other hand, lamp L2 rather than lamp L1 fails with switch F in the 2 position, voltage sensor 2VS activates switch K2 which closes contacts 115 thereby permitting power to activate solenoid B2 and indicator light 126. Activation of solenoid B2 closes contacts 116, 117 and 118 and opens contacts 119 and 120. Opening of contacts 120 inactivates solenoid 2LC which causes contacts 90 and 91 of switch 2LC to open thereby removing the application of electrical potential from lamp L2. Closure of contacts 118 provides a path for power to solenoid B2 and indicator light 126 which bypasses contacts 115 of switch K2. The purpose and operation of this bypass are the same as heretofore described. Remembering that contacts 106 are closed because switch F is in the 3 position, closure of contacts 117 permits power to activate solenoid 2DK which closes contacts 78 of switch 2DK. Closure of contacts 116 does not provide a path for operation of solenoid 1DK inasmuch as contacts 103 are open. Power is not supplied to solenoid 1DK through contact 101 because contacts 112 are open. Therefore, opening of contacts 119 inactivates solenoid 1DK which opens contacts 50 of switch 1DK. Power is supplied to lamp L1 through capacitors C1 and C2 so that lamp L2 now emits with an intensity (¾)E. The net result of the failure of lamp L2 is that the intensity of lamp L1 is increased from (½)E to (¾)E so that the pre-burnout total intensity of (¾)E is maintained. When lamp L1 and lamp L2 are located at the first foci of a conjugate reflector system, the intensity profile is also substantially maintained. When the two lamp system described above is employed as a part of a four lamp cluster, as for example the clusters shown in FIGS. 5 and 6, it is preferred that lamp L2 be located at an extreme, or outer, first focus, such as first focus 29 of FIG. 6, and that lamp L1 be located at the adjacent first focus, such as first focus 28 of FIG. 6. Nevertheless, it is quite acceptable for lamp L1 to be located at first focus 29 and for lamp L2 to be located at first focus 28 of FIG. 6. In FIG. 5, it is permissible for lamps L1 and L2 to be located at any first focus.

When switch F is in the 3 position, the total intensity of the two lamp system is E. With switch F in the 3 position, contacts 66 are closed and contacts 62 and 64 are open. Solenoid T is therefore activated which closes contacts 108, 109, 110 and 111. Solenoids Y and Z remain inactivated, hence contacts 103, 104, 105, 106 and 107 remain open and contacts 101, 102, 112 and 113 remain closed. Because contacts 114 of switch K1 remain open, solenoid B1 remains inactivated and contacts 54, 56 and 58 remain open while contacts 52 remain closed. Similarly, because contacts 115 of switch k2 remain open, solenoid B2 remains inactivated and contacts 116, 117 and 118 remain open while contacts 119 and 120 remain closed. When switch 115 is in either the full position or the low position, contacts 121 and 122 are in the closed position. When switch 2LS is in either the full position or the low position, contacts 123 and 124 are in the closed position. Because contacts 121 are closed, power is supplied to voltage sensor 1VS which functions as hereinbefore described. Because contacts 123 are closed, power is supplied to voltage sensor 2VS which functions as described above.

When switch F is in the 3 position, both lamps are functioning and neither switch 1LS nor switch 2LS is in the off position, then solenoid 1DK is activated by power supplied through contacts 112, 108 and 101 and solenoid 3DK is activated by power supplied through contacts 113, 110 and 102. Solenoids 2DK and 4DK remain inactivated. Activation of solenoid 1DK closes contacts 50 of switch 1DK. Power is therefore supplied to lamp L1 through capacitors C1 and C3. Activation of solenoid 3DK closes contacts 92 of switch 3DK. Power is therefore supplied to lamp L2 through capacitors C4 and C6. Lamps L1 and L2 each emit with an intensity (½)E, and the total intensity of the two lamp system is E. If lamp L1 fails, voltage sensor 1VS activates switch K1 which closes contacts 114 thereby permitting power to activate solenoid B1 and indictor light 125. Activation of solenoid B1 closes contacts 54, 56 and 58 and opens contacts 52. Opening of contacts 52 inactivates solenoid 1LC which causes contacts 73 and 74 of switch 1LC to open thereby removing the application of electrical potential from lamp L1. Closure of contacts 54 provides a path for power to solenoid B1 and indicator light 125 which bypasses contacts 114 of switch K1. The purpose and operation of this bypass are the same as heretofore described. Remembering that contacts 111 are closed because switch F is in the 3 position, the closure of contacts 58 permits power to activate solenoid 4DK which closes contacts 93 of switch 4DK. Closure of contacts 56 is ineffective to provide an additional path to supply power to solenoid 3DK because contacts 104 are open, but solenoid 3DK continues to be supplied through contacts 113, 110 and 102. Power is supplied to lamp L2 through capacitors C4, C5 and C6 so that lamp L2 now emits with an intensity E. The net result of the failure of lamp L1 is seen to be that the intensity of lamp L2 is increased from (½)E to E so that the pre-burnout total intensity of E is maintained. When lamps L1 and L2 are located at the first foci of a conjugate reflector system, the intensity profile is also substantially reestablished.

If, on the other hand, lamp L2 rather than lamp L1 fails with switch F in the 3 position, voltage sensor 2VS activates switch K2 which closes contacts 115 thereby permitting power to activate solenoid B2 and indicator light 126. Activation of solenoid B2 closes contacts 116, 117 and 118 and opens contacts 119 and 120. Opening of contacts 120 inactivates solenoid 2LC which causes contacts 90 and 91 of switch 2LC to open thereby removing the application of electrical potential from lamp L2. Closure of contacts 118 provides a path for power to solenoid B2 and indicator light 126 which bypasses contacts 115 of switch K2. The purpose and operation of this bypass are the same as described heretofore. Remembering that contacts 109 are closed because switch F is in the 3 position, closure of contacts 117 permits power to activate solenoid 2DK which closes contacts 78 of switch 2DK. Closure of contacts 116 does not provide an additional path to supply power to solenoid 1DK because contacts 103 are open, but solenoid 1DK continues to be supplied through contacts 112, 108 and 101. Power is supplied to lamp L1 through capacitors C1, C2 and C3 so that lamp L1 now emits with an intensity E. The net result of the failure of lamp L2 is seen to be that the intensity of lamp L1 is increased from (½)E to E so that the pre-burnout total intensity of E is maintained. When lamps L1 and L2 are located at the first foci of a conjugate reflector system, the intensity profile is also substantially reestablished.

When switch F is in the 1 position, the 2 position or the 3 position, and neither switch 1LS nor switch 2LS is in the off position, the total intensity of the optical system is determined by the position of switch F. Therefore, it is immaterial whether switch 1LS is in the full position or the low position or whether switch 2LS is in the full position or the low position under these circumstances.

The use of indicator lamps 125 and 126 is optional and may be omitted. If omitted, the lines in which they are positioned should be left open. Other warning devices such as horns, sirens or bells may be used in addition to or in lieu of the indicator lights.

Voltage sensors 1VS and 2VS may be replaced by other well-known sensors such as by sensors monitoring the flow of current to the lamps or by photoelectric sensors which monitor the light emission intensity of the lamps.

Any suitable source which emits ultraviolet light, viz., electromagnetic radiation having a wavelength in the range of from about 180 to about 400 nanometers, may be used in the practice of this invention. Suitable sources are mercury arcs, carbon arcs, low pressure mercury lamps, medium pressure mercury lamps, high pressure mercury lamps, swirl-flow plasma arc, ultraviolet light emitting diodes and ultraviolet light emitting lasers. Particularly preferred are ultraviolet light emitting lamps of the medium or high pressure mercury vapor type. Such lamps usually have fused quartz envelopes to withstand the heat and transmit the ultraviolet radiation and are ordinarily in the form of long tubes having an electrode at both ends. Examples of these lamps are PPG Models 60-2032, 60-0393, 60-0197 and 60-2031 and Hanovia Models 6512A431, 6542A431, 6565A431 and 6577A431.

The voltages and currents used to operate the ultraviolet light sources are known in the art. When, for example, the ultraviolet light emitting lamps L1 and L2 are metal halide seeded medium pressure mercury lamps, each having a length of about 63.5 centimeters, an alternating current voltage of 480 volts may be applied to lines 71 and 72 of FIG. 12, and the secondary voltage of saturable core transformers 1ST and 2ST may be about 800 volts. Each lamp then draws about 6.4 amperes.

FIG. 14 shows a power supply system which is a modification of the system shown in FIG. 12. Lines 71 and 72, contacts 73 and 74 of switch 1LC, contacts 90 and 91 of switch 2LC, the fuses and saturable core transformers 1ST and 2ST all function as described with respect to FIG. 12. However, capacitors C1, C2 and C3 and switches 1DK and 2DK have been replaced by variable capacitor 140 and capacitors C4, C5 and C6 and switches 3DK and 4DK have been replaced by variable capacitor 142. Using this modified system, the emission intensities of lamps L1 and L2 may be varied smoothly and set at any value within the operational limits of the capacitors 140 and 142 and lamps L1 and L2.

Figure 15:
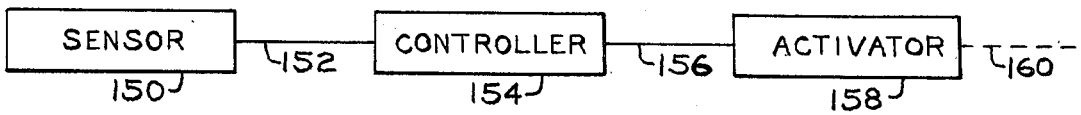
FIG. 15 is a control system for operating the electrical system of FIG. 14.

While capacitors 140 and 142 may be adjusted manually, it is preferred that they be varied automatically. FIG. 15 shows a system for automatically adjusting variable capacitor 140. Sensor 150 monitors, directly or indirectly, the intensity of lamp L2. A photoelectric detector may be used to monitor the light from lamp L2 directly. A voltage sensor or a current sensor may be used to monitor the electrical input into lamp L2 and hence measure light intensity directly. Sensor 150 is connected by line 152 to controller 154. Controller 154 is of conventional design and may be, for example, any of the pneumatic or electronic controllers widely used for process control. The output from controller 154 is transmitted via line 156 to activator 158 which adjusts variable capacitor 140 by any suitable linkage 160. The system is arranged such that a reduction in intensity of lamp L2 is detected by controller 154 which causes activator 158 to adjust variable capacitor 140 so that the intensity of lamp L1 increases by about the amount necessary to compensate for the reduction in intensity of lamp L2. Similarly, should the intensity of lamp L2 increase, controller 154 causes activator 158 to adjust variable capacitor 140 so that the intensity of lamp L1 diminishes by about the amount necessary to compensate for the increase in intensity of lamp L2. The normal operating intensity of lamp L1 is established by the position of the set point of controller 154. A duplicate system may be installed to control the intensity of lamp L2, where sensor 150 monitors the intensity of lamp L1 and activator 158 adjusts variable capacitor 142.

The system shown in FIG. 15 may also be arranged such that sensor 150 monitors the total intensity of lamps L1 and L2 and the activator 158 adjusts both variable capacitor 140 and variable capacitor 142 to compensate for deviations from the set point. Should the intensity of either or both lamps diminish, the activator adjusts both variable capacitors to counteract the reduction in intensity. If, for example lamp L1 should fail, variable capacitors 140 and 142 are adjusted to increase the power delivered to both lamps. Since lamp l1 has failed, it cannot consume power or emit light. Therefore, adjustment of variable capacitor 140 will be ineffectual. Activator 158 then continues to adjust variable capacitor 142 until the intensity of lamp L2 is about the same as the pre-burnout total intensity. This system may be used to regulate the total intensity of an optical system containing two or more than two lamps. If more than two lamps are employed, the failure of one will cause the others to increase in intensity so that the total intensity of the system is substantially reestablished to that before the failure.

Substantially any ultraviolet light curable coating composition can be cured using the present invention. These ultraviolet light curable coating compositions contain at least one polymer, oligomer or monomer which is ultraviolet light curable. Examples of such ultraviolet light curable materials are unsaturated polyesters, acrylic (including the $\alpha$-substituted acrylic) functional monomers, oligomers and polymers, the epoxy resins in admixture with masked Lewis acids, and the aminoplasts used in combination with a compound which ultraviolet light converts to an acid. Examples of such a compound to be used with aminoplast resins are the chloromethylated or bromomethylated aromatic ketones as exemplified by chloromethylbenzophenone.

The most commonly used ultraviolet light curable compounds contain a plurality of sites of ethylenic unsaturation which, under the influence of ultraviolet light become crosslinking sites through addition reactions. The sites of ethylenic unsaturation may lie along the backbone of the molecule or they may be present in side chains attached to the molecular backbone. As a further alternative, both of these arrangements may be present concurrently.

The ethylenically unsaturated polyesters constitute a preferred class of ultraviolet light curable polymer. These polyesters are ordinarily esterification produces of ethylenically unsaturated polycarboxylic acids and polyhydric alcohols. Usually, the ethylenic unsaturation is in the alpha, beta position.

For purposes of the present invention, the aromatic nuclei of aromatic compounds such as phthalic acid are generally regarded as saturated since the double bonds do not ordinarily react by addition as do ethylenic groups. Therefore, wherever the term "saturated" is utilized, it is to be understood that such term includes aromatic unsaturation or other form of unsaturation which does not react by addition, unless otherwise qualified.

Organic ultraviolet light curable acrylic oligomers, which may be used in the invention, generally comprise divalent, trivalent or tetravalent organic radicals whose bonds are satisfied with unsubstituted acrylyloxy or $\alpha$-substituted acrylyloxy groups. The polyvalent radical may be aliphatic, cycloaliphatic or aromatic. Usually, the molecular weight of the oligomer is in the range of from about 170 to about 1000. Examples of such oligomers are the diacrylates and dimethacrylates of ethylene glycol, 1,3-propanediol, propylene glycol, 2,3-butanediol, 1,4-butanediol, 2-ethylbutane-1,4-diol, 1,5-pentanediol, 1,6-hexanediol, 1,7-heptanediol, 1,8-octanediol, 1,9-nonanediol, 1,10-decanediol, 2,10-decanediol, 1,4-cyclohexanediol, 1,4-dimethylolcyclohexane, 2,2-diethylpropane-1,3-diol, 2,2-dimethylpropane-1,3-diol, 3-methylpentane-1,4-diol, 2,2-diethylbutane-1,3-diol, 4,5-nonanediol, diethylene glycol, triethylene glycol, dipropylene glycol, neopentyl glycol, 5,5-dimethyl-3,7-dioxanonane-1,9-diol and 2,2-dimethyl-3-hydroxypropyl 2,2-dimethyl-3-hydroxypriopionate; the triacrylates, trimethacrylates, diacrylates and dimethacrylates of glycerol, 1,1,1-trimethylolpropane and trimethylolethane; and the tetracrylates, tetramethacrylates, triacrylates, trimethacrylates, diacrylates and dimethacrylates of pentaerythritol and erythritol. The acrylic groups on the oligomer molecules are usually the same, but they may be different as exemplified by the compound 2,2-dimethyl-1-acrylyloxy-3-methacrylyloxypropane.

Other examples of satisfactory acrylic oligomers are acrylic polyester and acrylic polyamide molecules represented by the formulae

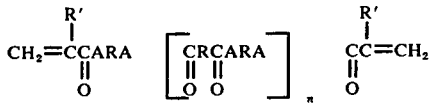

(I)

and

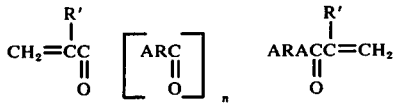

(II)

wherein

*n* is an integer in the range of from 1 to 4;

each R independently represents a divalent aliphatic, cycloaliphatic or aromatic hydrocarbon radical having from 1 to 10 carbon atoms;

each R′ independently represents hydro, methyl or ethyl;

and each A independently represents O or NH. It is preferred that every A represent O. The polyester and polyamide oligomers represented by formula (I) may be prepared by reacting dicarboxylic acids or acid amides and dihydric alcohols ordiamines and then reacting the product with an unsubstituted acrylic acid or an α-substituted acrylic acid. The acrylic polyester and polyamide oligomers represented by formula (II) may be prepared by reacting a hydroxyfunctional monocarboxylic acid, a dimer, trimer or a tetramer of such acid, an amino functional monocarboxylic acid or a dimer, trimer or tetramer of such acid with an unsubstituted or α-substituted acrylic acid. Where desired, the lactone may be used in lieu of the hydroxy functional monocarboxylic acid and the lactam may be used in place of the amino functional monocarboxylic acid.

Vinyl monomers which crosslink with the compound containing a plurality of sites of ethylenic unsaturation to form thermosetting materials may be present in the coating composition. Vinyl monomers are especially used with the unsaturated polyesters. Examples of vinyl monomers which may be used are styrene, α-methylstyrene, divinylbenzene, methyl acrylate, methyl methacrylate, ethyl acrylate, ethyl methacrylate, propyl acrylate, propyl methacrylate, butyl acrylate, butyl methacrylate, hexyl acrylate, hexyl methacrylate, octyl acrylate and octyl methacrylate. The preferred vinyl monomers are liquid compounds miscible with the first component. These vinyl monomers are preferably free of non-aromatic carbon-carbon conjugated double bonds. The use of one or more vinyl monomers is desirable because the greater mobility of the smaller vinyl monomer molecule, as compared to the much larger first component, allows crosslinking to proceed faster than if the vinyl monomer were absent. Another benefit is that the vinyl monomer usually acts as a reactive solvent for the first component thereby providing coating compositions having a satisfactorily low viscosity without using an inordinate amount, if any at all, of volatile, non-reactive solvent.

The vinyl monomer, or mixtures of vinyl monomers, may be employed over a broad range. At the lower end of the range, no vinyl monomer need be used. The upper end of the range is a moderate excess of vinyl monomer over the stoichiometric amount required to crosslink the ethylenic unsaturation of the first component. The amount of monomer should be sufficient to provide a liquid, flowable, interpolymerizable mixture. Ordinarily, the monomer will be present in the coating composition in the range of from about 0 to about 45 percent by weight of the binder of the coating composition. When used, the vinyl monomer will ordinarily be in the range of from about 15 to about 30 percent by weight of the binder.

Extender pigments which are generally transparent to both ultraviolet light and visible light are optional ingredients which are often included in the coating composition. Examples of suitable extender pigments are finely divided particles of silica, barytes, calcium carbonate, talc, magnesium silicate, aluminum silicate, etc. The extender pigments do not ordinarily provide significant additional hiding, but they accelerate the rate at which opacity is obtained. Extender pigment is generally present in an amount in the range of from about 0 to about 40 percent by weight of the coating composition. An amount in the range of from about 0 to about 15 percent is more often employed. When extender pigment is used, it is usually present in the range of from about 1 to about 15 percent by weight of the coating composition. Although a single extender pigment is ordinarily used, mixtures of several extender pigments are satisfactory.

Opacifying or coloring pigments may also be included in the ultraviolet light curable coating compositions. The amount of these pigments should not be so great as to seriously interfere with the curing of the binder. Dyes and tints may similarly be included.

Another optional ingredient which is often included in the coating composition is an inert volatile organic solvent.

Photoinitiators, photosensitizers or both photoinitiators and photosensitizers are often included in ultraviolet light curable coating compositions. These materials are well known to the art. The preferred photosensitizer is benzophenone and the preferred photoinitiators are isobutyl benzoin ether, mixtures of butyl isomers of butyl benzoin ether and α,α-diethoxyacetophenone.

The photoinitiator, photosensitizer or mixture of these is usually present in the ultraviolet light curable coating composition in an amount in the range of from about 0.01 percent to about 50 percent by weight of the binder of the coating composition. An amount in the range of from about 0.05 percent to about 10 percent is more often used. An amount in the range of from about 0.1 percent to about 5 percent is preferred.

Although several of the optional materials commonly found in ultraviolet light curable coating compositions have been described, the list is by no means inclusive. Other materials may be included for purposes known to the art.

Although the curing of the uncrosslinked coating composition (A-stage) may be carried out only until a gel (B-stage) is formed, it is generally preferred that curing should continue until the fully cured state (C-stage) is obtained where the coating has been crosslinked into a hard, infusible film. These fully cured films exhibit the high abrasion resistance and high mar resistance customarily associated with C-stage polymer films.

The ultraviolet light curable coating compositions are used to form cured adherent coatings on substrates. The substrate is coated with the coating composition using substantially any technique known to the art. These include spraying, curtain coating, dipping, roller application, painting, brushing, printing, drawing and extrusion. The coated substrate is then passed under the reflectors of the ultraviolet light processor so that the coating is exposed to ultraviolet light of sufficient intensity for a time sufficient to crosslink the coating during the passage.

The times of exposure to ultraviolet light and the intensity of the ultraviolet light to which the coating composition is exposed may vary greatly. Generally the exposure to ultraviolet light should continue to the C-stage when hard, mar and abrasion resstant films of low gloss result. In certain applications, however, it may be desirable for the curing to continue only to the B-stage.

Substrates which may be coated with the compositions of this invention may vary widely in their properties. Organic substrates such as wood, fiberboard, particle board, composition board, paper, cardboard and various polymers such as polyesters, polyamides, cured phenolic resins, cured aminoplasts, acrylics, polyurethanes and rubber may be used. Inorganic substrates are exemplified by glass, quartz and ceramic materials. Many metallic substrates may be coated. Exemplary metallic substrates are iron, steel, stainless steel, copper, brass, bronze, aluminum, magnesium, titanium, nickel, chromium, zinc and alloys.

Cured coatings of the ultraviolet light curable coating composition usually have thicknesses in the range of from about 0.001 millimeter to about 3 millimeters. More often they have thicknesses in the range of from about 0.007 millimeter to about 0.3 millimeter. When the ultraviolet light curable coating composition is an ultraviolet light curable printing ink, the cured coatings usually have thicknesses in the range of from about 0.001 millimeter to about 0.03 millimeter.

I claim:

1. In an ultraviolet light processor having an optical system comprising a plurality of concave substantially elliptical cylindrical reflectors for reflecting light from generally linear parallel sources of ultraviolet light located at the first foci of said reflectors to the second foci thereof, said second foci being more remotely located from said reflectors than said first foci, the improvement comprising:

a. the second foci of a plurality of said substantially elliptical reflectors being superimposed at a common focus to form a conjugate reflector system;

b. first means for increasing the intensity of at least one of said sources located at the first focus of a said reflector of said conjugate reflector system;

c. second means for detecting a reduction in intensity of another of said sources located at the first focus of another said reflector of said conjugate reflector system; and d. third means for activating said first means in response to detection of a reduction in intensity of said other source by said second means whereby in response to a detection of a reduction in intensity of said other source by said second means, said third means causes said first means to increase the intensity of said first source to thereby reestablish the total intensity to substantially that before said reduction in intensity and substantially reestablish the intensity profile.

2. The ultraviolet light processor of claim 1 wherein the eccentricity of said substantially elliptical cylindrical reflectors is in the range of from about 0.2 to about 0.9.

3. The ultraviolet light processor of claim 1 wherein the second foci of all of said substantially elliptical cylindrical reflectors are superimposed at a common focus.

4. The ultraviolet light processor of claim 1 wherein the second foci of a plurality of said substantially elliptical cylindrical reflectors are superimposed at a first common focus and the second foci of another plurality of said substantially elliptical cylindrical reflectors are superimposed at a second common focus, which is spaced apart from said first common focus.

5. The ultraviolet light processor of claim 1 including means for varying the total intensity of the sources of ultraviolet light located at the first foci of said reflectors of said optical system.

6. The ultraviolet light processor of claim 1 wherein said third means activates said first means only after said second means detects the intensity of said other source reduced to a preestablished value which is below the normal operating intensity of said other source.

7. The ultraviolet light processor of claim 6 wherein said preestablished value is at least about 20 percent below the normal operating intensity of said other source.

8. In an ultraviolet light processor having an optical system comprising a plurality of concave substantially elliptical cylindrical reflectors for reflecting light from generally linear parallel sources of ultraviolet light located at the first foci of said reflectors to the second foci thereof, said second foci being more remotely located from said reflectors than said first foci, the improvement comprising:

a. the second foci of a plurality of said substantially elliptical reflectors being superimposed at a common focus to form a conjugate reflector system;

b. first means for varying the intensity of at least one of said sources located at the first focus of a said reflector of said conjugate reflector system;

c. an activator for adjusting said first means;

d. a sensor for determining the intensity of another of said sources located at the first focus of another said reflector of said conjugate reflector system; and e. a controller for comparing the intensity of said other source as determined by said sensor with a setpoint and, upon detecting a difference therein, causing said first means to adjust the intensity of said first source to thereby substantially reestablish the total intensity to a predetermined value and substantially reestablish the intensity profile.

9. The ultraviolet light processor of claim 8 wherein the eccentricity of said substantially elliptical cylindrical reflectors is in the range of from about 0.2 to about 0.9.

10. The ultraviolet light processor of claim 8 wherein said sensor and said controller function continuously.

11. The ultraviolet light processor of claim 8 including means for varying the total intensity of the sources of ultraviolet light located at the first foci of said reflectors of said optical system.

12. In a ultraviolet light processor having an optical system comprising a plurality of concave substantially elliptical cylindrical reflectors for reflecting light from generally linear parallel sources of ultraviolet light located at the first foci of said reflectors to the second foci thereof, said second foci being more remotely located from said reflectors than said first foci, the improvement comprising:

a. the second foci of said substantially elliptical reflectors being superimposed at a common focus to form a conjugate reflector system;

b. first means for varying the intensity of such of said sources as are functional;

c. an activator for adjusting said first means;

d. a sensor for determining the total intensity of said sources;

e. a controller for comparing said total intensity as determined by said sensor with a setpoint and, upon detecting a difference therein, causing said first means to adjust the intensity of such of said sources as are functional to thereby substantially reestablish the total intensity to a predetermined value and substantially reestablish the intensity profile.

13. The ultraviolet light processor of claim 12 wherein the eccentricity of said substantially elliptical cylindrical reflectors is in the range of from about 0.2 to about 0.9.

14. The ultraviolet light processor of claim 12 including means for varying the total intensity of the sources of ultraviolet light located at the first foci of said reflectors of said optical system.

15. In an ultraviolet light processor having an optical system comprising a cluster of four concave substantially elliptical cylindrical reflectors for reflecting light from generally linear parallel sources of ultraviolet light located at the first foci of said reflectors to the second foci thereof, said second foci being more remotely located from said reflectors than said first foci, wherein a. the eccentricity of said substantially elliptical cylindrical reflectors is in the range of from about 0.2 to about 0.9;

b. the second foci of a first pair of said reflectors which are adjacent are superimposed to form a common focus;

c. the second foci of the second pair of said reflectors which are adjacent are superimposed to form a common focus;

the improvement comprising d. first means for increasing the intensity of a first source of said first pair;

e. second means for increasing the intensity of a second source of said first pair;

f. third means for increasing the intensity of a first source of said second pair;

g. fourth means for increasing the intensity of a second source of said second pair;

h. fifth means for detecting a failure of said first source of said first pair;

i. sixth means for detecting a failure of said second source of said first pair;

j. seventh means for detecting a failure of said first source of said second pair;

k. eighth means for detecting a failure of said second source of said second pair;

l. ninth means for activating said first means in response to detection of failure of said second source of said first pair by said sixth means to increase the intensity of said first source of said first pair to thereby reestablish the total intensity to substantially that before said failure of said second source of said first pair and to substantially reestablish the intensity profile;

m. tenth means for activating said second means in response to detection of failure of said first source of said first pair by said fifth means to increase the intensity of said second source of said first pair to thereby reestablish the total intensity to substantially that before said failure of said first source of said first pair and to substantially reestablish the intensity profile;

n. eleventh means for activating said third means in response to detection of failure of said second source of said second pair by said eighth means to increase the intensity of said first source of said second pair to thereby reestablish the total intensity to substantially that before said failure of said second source of said second pair and to substantially reestablish the intensity profile;

o. twelfth means for activating said fourth means in response to detection of failure of said first source of said second pair by said seventh means to increase the intensity of said second source of said second pair to thereby reestablish the total intensity to substantially that before said failure of said first source of said second pair and to substantially reestablish the intensity profile.

16. The ultraviolet light processor of claim 15 wherein the common focus of said first pair are superimposed upon the common focus of said second pair.

17. The ultraviolet light processor of claim 15 wherein the common focus of said first pair are spaced apart from the common focus of said second pair.

18. The ultraviolet light processor of claim 15 wherein the common focus of said first pair are spaced apart from the common focus of said second pair by a distance in the range of from about 10 percent to about 50 percent of the distance between the two extreme first foci.

19. The ultraviolet light processor of claim 15 including means for varying the total intensity of the sources of ultraviolet light located at the first foci of said reflectors of said optical system.

* * * * *

UNITED STATES PATENT AND TRADEMARK OFFICE

CERTIFICATE OF CORRECTION

PATENT NO. : 3,984,726

DATED : October 5, 1976

INVENTOR(S) : Warren J. Ramler

It is certified that error appears in the above-identified patent and that said Letters Patent are hereby corrected as shown below:

Column 2, line 68, "e = Z-z/Z+z" should be --$e = \frac{Z-z}{Z+z}$--.

Column 19, line 15, "a" first occurrence should be --an--.

Signed and Sealed this

Twenty-second Day of February 1977

[SEAL]

*Attest:*

RUTH C. MASON
*Attesting Officer*

C. MARSHALL DANN
*Commissioner of Patents and Trademarks*